United States Patent [19]

Landeroin Duvernois

[11] 4,041,438

[45] Aug. 9, 1977

[54] ELECTRIC HEATING DEVICE

[76] Inventor: Odette Landeroin Duvernois, "L'Archerie", Cellettes, 41120 Les Montils, France

[21] Appl. No.: 658,865

[22] Filed: Feb. 17, 1976

[51] Int. Cl.[2] ..... H01C 1/024

[52] U.S. Cl. ..... 338/237; 219/353; 219/355; 219/357; 219/553; 338/268; 338/270; 338/302; 338/316

[58] Field of Search ..... 338/234, 235, 236, 237, 338/268, 276, 270, 274, 302, 316; 219/352, 353, 354, 355, 356, 357, 534, 553; 29/611, 613; 313/256, 274–276, 279, 285, 289

[56] References Cited

U.S. PATENT DOCUMENTS

| | | | |
|---|---|---|---|
| 2,559,943 | 7/1951 | Ceruy | 338/237 |
| 2,757,310 | 7/1956 | Robinson et al. | 313/289 X |
| 2,894,166 | 7/1959 | Mohn | 219/353 X |

*Primary Examiner*—C. L. Albritton
*Attorney, Agent, or Firm*—Young & Thompson

[57] ABSTRACT

This electric heating device comprises a support surrounded by a resistance wire and located within a vacuum outer tube, said resistance being spaced from the inner surface of the outer tube. In order properly to position the support and resistance wire on the center axis of the tube, a mounting assembly is provided at each end of the support. Said mounting assembly comprises a resilient cap-shaped centering member having an annular ring portion surrounding the support, clips limiting the engagement of said cap-shaped member onto said support, and outwardly extending resilient arms engaging the inner surface of the outer tube in order to center the support and resistance wire within said outer tube. A supply lead is connected between said resistance wire and an output/input conductor. Said supply lead comprises a longitudinal portion extending along the support and a radial portion connected to said conductor within a supporting glass case or bead projecting into the outer tube from its end. A retaining wire diametrically opposite to said supply lead comprises a radial portion and a longitudinal portion extending along said support and terminating in a beak-like end engaged into a recess of the support, for retaining said support in the longitudinal direction. The two mentioned radial portions are flexible for compensating the differential thermal expansion.

14 Claims, 3 Drawing Figures

ELECTRIC HEATING DEVICE

GENERAL DISCLOSURE

This invention relates, generally, to electric heating devices, and more particularly, though not exclusively, to devices or apparatus for electric space heating.

It is already established practice to heat a space electrically by means of devices which are advantageously in the form of plinths or equivalent units in which is usually fixed a heating element.

In a known electric heating device of this type, a heating element consists of an electrical resistance coiled about a support part and placed with this part in a vacuum tube of special glass, which may, in particular, be Pyrex.

There are numerous advantages to this method of heating. In particular, the quantity of heat released by the wire forming the resistance is transmitted in its entirety to the external tube across the vacuum, so that the latter can transmit this heat to the surrounding atmosphere by radiation from a distinctly larger surface than that of the wire forming the resistance. In addition, the use of an external tube of special glass, particularly of Pyrex, permits the filtering of the heat rays and the transmission of only those rays of a wave length greater than a given wave length, by eliminating in principle the ultraviolet and other harmful rays. Finally, the transmission of the heat from the wire forming the resistance across the vacuum to the tube allows the wire to work without becoming red, at a temperature greater than would be the case in air, consequently permitting the attainment of better efficiency per unit length of the heating element, whilst retaining the advantages arising from the use of a heating element not brought to the point of becoming red.

However, certain problems in fact arise by this technique as regards the centering of the internal support of the heating element and the accommodation of the differential expansion between the support of the heating element and the external tube in which it is mounted, resulting from the differences in temperature to which these parts are brought.

An object of the invention is to create a device solving the above-mentioned problem.

Another object of the invention is to provide an electric heating element of the type comprising a wire forming a resistance coiled about a support and placed together with the latter within a tube in which a vacuum has been created, wherein the support for the resistance forming wire is encircled at each end by a part fitted with arms projecting radially outwardly from the periphery of this support and having some elasticity of movement, these arms when mounted engaging against the inside surface of the external tube, for the purpose of holding the said support in a central position, and wherein it is provided, between the input or output conductor at each end of the heating element and the resistance wire, a supply lead co-operating with the above-mentioned support to maintain its central position.

The said part is advantageously in the form of a cap, open on its periphery and spring locked onto the end of the support.

Another object of the invention is to provide a heating element wherein each supply lead is linked by means of a crimped sleeve or other method, at one end, to the corresponding end of the resistance wire, and at its other end, it is soldered or linked by some other means to an axial input or output conductor projecting from the external tube, a holding member being connected to this other end of the supply lead, with respect of which it is diametrically opposed relative to the support, the supply lead and this holding member being secured on this support in that position.

The holding member may usefully be made of a metal wire of the same type as the supply lead, thus facilitating assembly by soldering, and favorable arrangement is for its end opposite that end which is linked to the supply lead being inserted in a retaining recess provided in the support, for example by means of a small section bent in the form of a beak provided at that end.

A favorable arrangement is for the supply lead and the wire forming the holding member to extend inwardly in a direction which is substantially radial from two diametrically opposed longitudinal parts, the two ends of this lead and of this wire being connected by soldering to the input or output conductor.

The terminal section of the support, including the cap, the supply lead and the holding wire are surrounded by a retaining ring, which may be sprung onto this section of the support and which ensures the firm positioning of the above-mentioned parts. This ring should advantageously be split and usefully has two opposed slots to retain the supply lead and the holding member.

The above-mentioned ring may, if desired be in the form of a polygon or star, to provide legs resting on the inside surface of the external tube, thus improving the centering of the support and of the resistance wire in relation to this external tube.

Figure 1:
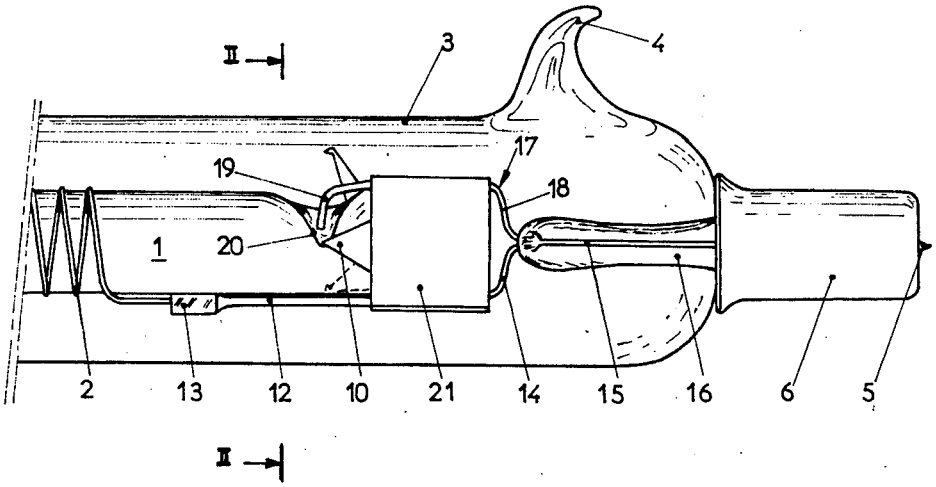
FIG. 1 is an elevational view of the terminal section of a heating element in accordance with the invention.

The heating element partially illustrated in FIG. 1 comprises an internal elongated support 1, which in this case is made of a Pyrex glass tube or similar material of small diameter, surrounded along its length by a resistance wire 2, the support 1 and the wire 2 being themselves surrounded at a distance by a tube 3 in Pyrex glass or similar material, in which a vacuum has been created and which has subsequently been closed by a nipple 4.

In the heating element thus described, the connections are made at the opposite ends, to prevent short circuits by sparking, and the supply is brought in by an input or output conductor 5, for example of nickel, secured in a base terminal or cap 6.

Figure 3:
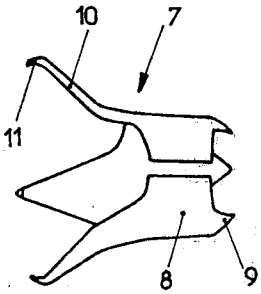
FIG. 3 shows the cap fitted on the end of the support which is hidden by the ring in FIG. 1.

All these parts are known. According to the invention the terminal section of the tube forming the support 1 is covered by a metal cap 7, in stainless steel for example, which is shown in FIG. 3. This cap comprises a part forming a ring 8 open on its periphery to allow the cap to be sprung onto the end of the support, and clips 9 slightly bent towards the interior, for the purpose of acting as a stop against the end of the support to limit engagement of the cap 7 onto the support.

Near the other end of the cap 7, opposite to the clips 9, are provided arms 10 pointing obliquely outwardly, terminating in folded back ends 11. It will be realised that the arms 10 have a certain amount of radial elasticity. When mounted, they engage or rest against the inside face of the wall of the outer tube 3, as is clearly shown in particular in FIG. 2. In this condition, they maintain in a central position the support 1 and the resistance wire 2 within the external tube 3. In the mounted position, the bent ends 11 of the arms 10 rest against the inside surface of the external tube 3, thus providing small bearing surfaces and avoiding a point support.

As shown in FIG. 1, a supply lead 12, of nickel for example, is connected at 13 to the end of the resistance wire 2 by a crimped sleeve. This lead 12 extends along the length of the terminal part of the support 1, and near the end furthest from the resistance wire is bent to provide a substantially radial section 14, having a certain curvature and therefore a certain amount of springiness, this end of the supply lead 12 then extending lengthwise on the axis of the support, and being soldered onto a conductor 15 of tungsten for example, sunk in a bead or case of glass 16, of Pyrex for example, extending right into the base 6, and onto which the input or output conductor 5 is itself soldered. Tungsten has virtually the same coefficient of expansion as Pyrex and it is selected for preference in the present case for connection with the supply leads at the entrance or exit of the heating element.

Figure 2:
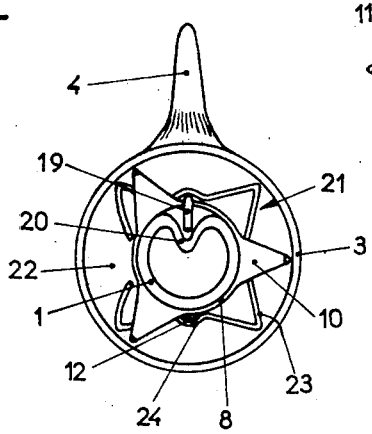
FIG. 2 is a sectional view along the line II—II in FIG. 1.

According to the invention, a second wire, of nickel for instance, is provided as indicated at 17, having an axial section which extends along the terminal part of the support as shown in FIG. 2, in a position diametrically opposite to the supply lead 12. This wire 17 has a radially bent part at one end, indicated at 18, which joins the axis of the support 1 and which is soldered with the supply lead 14 on the tungsten conductor 15 within the glass bead or case 16.

The holding wire 17 is bent radially and inwardly at its other end in the form of a beak 19, which fits into a recess 20 provided as shown in the periphery of the support tube 1. In this way, this beak, together with the recess 20, provides for the axial positioning of the wire 17 and also of the supply lead 12 and of the end of the resistance wire 2 in relation to the internal support 1, and likewise, since this holding wire 17 is soldered to the conductor 15 sunk into the glass case 16, which in turn is positioned in relation to the outer tube 3, it ensures that the inner support 1 is maintained in the required position axially in relation to this outer tube 3.

Freedom of the beak 19 in the recess 20 and the curved shape of the parts 14 and 18 of the supply lead 12 and of the wire 17 allow for the differential expansion of the support 1 in relation to the external tube 3 under the influence of the temperature differences to which these parts are submitted.

As shown in the drawings, the terminal part of the inner support 1, the cap 7, the supply lead 12 and the wire 17 are surrounded or encircled by a securing band indicated in a general way at 21. This band is open on its periphery as shown at 22 in FIG. 2, so that it is resilient and can likewise be spring fitted onto the above-mentioned parts.

According to the particular from of the invention being considered and as shown particularly in FIG. 2, the band 21 has in cross section a virtually square profile, but its angles project nevertheless as would the points of a star to make appreciable contact when mounted against the inner face of the outer tube 3, thus completing the centering of the internal support 1 and of the parts, by cooperation with the arms 10 of the cap 7.

Furthermore, the band 21 has in diametrically opposed places grooves 24, which allow the supply lead 12 and the wire 17 to pass through and to be secured.

It can thus be seen that when mounted, all these parts are perfectly assembled and positioned. The arms 10 of the cap 7 ensure the centering of the inner support 1 and of the interconnected parts within the external tube 3, in such a way as to allow a certain displacement, in particular to compensate for differential expansion. In this function, these arms work together with the edges of the parts forming the points 23 of the band 21. The axial expansions are compensated for by the play between the beak 19 and the recess.

Obviously, the same mounting assembly is provided at each end of the tube.

It will likewise be realized that the assembly of these parts can be easily achieved by simple fitting, that is if wished with the aid of a machine.

Although particular consideration has been given in this description to the application of the invention to an electrical heating device or apparatus for space heating, an electric heating element according to the invention can likewise be used for other applications and it can likewise, have non rectilinear forms.

What is claimed is:

1. In a electric heating element, comprising an elongated support, a resistance wire coiled about said support and an outer tube under vacuum surrounding said support and resistance wire while being spaced therefrom; a mounting assembly provided at each end of said support and comprising a centering part having resilient outwardly projecting arms, engaged over said end of said support, said arms extending up to the inner surface of said outer tube for centrally positioning said support within said outer tube, means for retaining said part on said support end, an axial conductor provided at each end of the electric heating element, and a supply lead extending between said conductor and said resistance wire.

2. A mounting assembly for an electric heating element according to claim 1, wherein said entering part comprises a resilient cap-shaped member having an annular ring portion, inwardly extending retaining portions provided at one end of said annular ring portion for limiting engagement of said cap-shaped member onto said support, and resilient outwardly projecting arms extending from the other end of said annular ring portion.

3. A mounting assembly for an electric heating element according to claim 2, wherein folded back end portions are provided at the ends of said resilient arms opposite to said annular ring portion, for providing bearing surfaces for the said arms on the inner surface of said outer tube.

4. A mounting assembly for an electric heating element according to claim 1, comprising means for connecting one end of said supply lead to said resistance wire, means for connecting the other end of said supply lead to said axial conductor, and a holding member arranged between said support and said axial conductor for holding said support from said axial conductor.

5. A mounting assembly for an electric heating element according to claim 1, comprising means for connecting one end of said supply lead to said resistance wire along said support, means for connecting the other end of said supply lead to said axial conductor, supporting means provided for said axial conductor within said outer tube, and a holding member connected to said supporting means and to said support for centering said support within said outer tube.

6. A mounting assembly for an electric heating element according to claim 5, wherein said means for connecting said supply lead to said resistance wire comprises a crimped sleeve.

7. A mounting assembly for an electric heating element according to claim 1, comprising means for connecting one end of said supply lead to said resistance wire, a supporting portion provided in an axial position within said outer tube, said axial conductor being embedded within said portion, the other end of said supply lead being connected to said axial conductor, and an elongated holding member connected to said supporting portion, diametrically opposite to said supply lead and engaged with said support.

8. A mounting assembly for an electric heating element according to claim 7, wherein said holding member is a wire extending from said glass portion, diametrically opposite to said supply lead and engaged with said support.

9. A mounting assembly for an electric element according to claim 8, wherein a beak like bent portion is provided at the end of said holding wire opposite to said supporting portion and a recess is provided in the support in a position diametrically opposite to said supply lead, said beak like portion being located within said recess for axially positioning and holding said support and resistance wire with respect to said supporting portion.

10. A mounting assembly for an electric heating element according to claim 1, comprising means for connecting one end of said supply lead to said resistance wire, an inwardly substantially radially bent portion provided near the other end of said supply lead, a glass supporting portion projecting into said outer tube in an axially centered position with respect to said outer tube, said axial conductor being embedded within said glass supporting portion, said other end of said supply lead being connected to said axial conductor, a holding wire extending from said glass supporting portion in a substantially radial direction, diametrically opposite to said supply lead, said holding wire having a longitudinal portion extending along said support and substantially parallel to said supply lead, up to a free end, a beak-like bent portion provided at said free end of said holding wire, and a recess provided in said support in an opposite position to said supply lead, said beak-like bent portion being engaged in said recess for axially positioning and holding said support and resistance wire from said glass supporting portion.

11. A mounting assembly for an electric heating element according to claim 10, wherein said radially bent portion of said supply lead and said radial portion of said holding wire are resilient for springy compensating the radial displacements of said parts of the electric heating element.

12. A mounting assembly for an electric heating element according to claim 2, comprising a retaining band encircling said annular ring portion of said centering part and said supply lead, said retaining band being split in its periphery for being resilient, and means provided on said retaining band extending up to the inner surface of said outer tube for resting on said inner surface of said outer tube.

13. A mounting assembly for an electric heating element according to claim 12, wherein said retaining band has a cross sectional shape in the form of a polygon having centering angles resting on said inner surface of said outer tube.

14. A mounting assembly for an electric heating element according to claim 12, wherein said securing band has a star cross-sectional shape providing centering points resting on said inner surface of said outer tube.

* * * * *